United States Patent [19]

Behringer et al.

[11] Patent Number: 5,065,417

[45] Date of Patent: Nov. 12, 1991

[54] METHOD AND APPARATUS FOR MONITORING THE PARTIAL DENSITY OF METAL AND ACID IN PICKLING BATHS

[76] Inventors: Jürgen Behringer, Am Alten Stadtpark 43, 4630 Bochum 1; Dieter Evers, Hubertusstrasse 14, 7541 Straubenhardt 1; Dieter Schönert, Bonhöfferstr. 4, 4630 Bochum, all of Fed. Rep. of Germany

[21] Appl. No.: 223,038

[22] Filed: Jul. 22, 1988

[30] Foreign Application Priority Data

Jul. 23, 1987 [DE] Fed. Rep. of Germany ..... 3724335

[51] Int. Cl.[5] ..... G01B 15/02

[52] U.S. Cl. ..... 378/54; 378/53

[58] Field of Search ..... 378/53, 54, 55, 56

[56] References Cited

U.S. PATENT DOCUMENTS

| | | | |
|---|---|---|---|
| 3,062,223 | 11/1962 | Malin et al. | 134/57 |
| 3,074,271 | 1/1963 | Hill | 73/439 |
| 4,200,792 | 4/1980 | Fanger et al. | 378/53 |

FOREIGN PATENT DOCUMENTS 1421755 1/1976 United Kingdom .

OTHER PUBLICATIONS

*Measurement and Control,* vol. 10, No. 3, Mar. 1977, pp. 83–87; D. R. Carlson: "Level and Density Measurement Using Non-Contact Nuclear Gauges" (*p. 86, para 3.1; FIG. 8*).

*Stahl U. Eisentl , vol. 85, No. 21, Oct. 21, 1965, pp. 1335–1340; no translation.*

*Primary Examiner*—Craig E. Church

*Attorney, Agent, or Firm*—Spensley Horn Jubas & Lubitz

[57] ABSTRACT

A method and an apparatus for determining the partial density, or concentration, of various substance components in a liquid, by calculating the absorption of two different gamma radiations, one of higher energy and one of lower energy. To this end, the liquid is carried in a conduit system, irradiated by the two gamma radiations, and the attenuation of their intensity is detected. A specific combination of the counting rates of the two radioactive sources is used for determining the partial density of two substances in a three-substance system. The primary field of application is the continuous, contactless monitoring of the acid and metal concentration in pickling baths for chemical descaling, and for roughening and cleaning of metal surfaces.

16 Claims, 2 Drawing Sheets

METHOD AND APPARATUS FOR MONITORING THE PARTIAL DENSITY OF METAL AND ACID IN PICKLING BATHS

BACKGROUND OF THE INVENTION

This invention relates to a method and an apparatus for measuring and monitoring the partial density of metal and acid in pickling baths.

When metal surfaces are pickled in order to remove deposits, usually oxide deposits, such as roll scale, hammer scale, corrosion films and the like, or to roughen them for special further processing purposes, or to clean the metal surfaces, inorganic and organic acids are used.

Chemical descaling after thermal deformation, for instance with a semi-finished product made of iron and iron alloys, is performed in mineral acids such as sulfuric acid, mixtures of nitric acid and hydrofluoric acid, or phosphoric acid.

The predominant reaction products of the pickling process are ferrous ions, as cations of the ferrous salt of the applicable pickling acid present in solution, and water, until the critical free iron surface is attained; upon further reduction of the mixed metal and metal oxide potential, atomic hydrogen occurs as well, which recombines into molecular hydrogen at lattice vacancies and forms gas bubbles.

When the solution equilibrium is exceeded, iron salts crystallize out, in various hydration forms that depend on the temperature and concentration.

For the design and operation of a pickling line the pickling speed is the essential factor; it is not only affected by the tendency of scale formation, but above all is a function of the acid concentration and the iron content, which increases with the dissolution of the scale. Other important factors are the temperature of the pickling solution and the movement of the material being pickled; other factors that affect the pickling time are the addition of an inhibitor and the presence of metallic and nonmetallic contaminants and impurities in the pickling solution.

The salt content in the various pickling acids has a variable effect on the pickling speed. With sulfuric acid, for example, an increasing content of ferrous sulfate reduces the pickling speed, and the ferrous ions have an inhibiting effect on the iron attack; on the other hand, with hydrochloric acid the pickling time decreases as the ferrous chloride content rises, until just below the limit of saturation, and the iron attack remains unretarded.

Modern pickling methods are coupled with regeneration systems for processing the used pickling solution. In pickling with sufuric acid, for example, the ferrous sulfate that forms must be continuously removed from the pickling process and the quantity consumed must be replenished with fresh sulfuric acid; in the case of hydrochloric acid, the used pickling solution can be regenerated virtually completely, that is, it is unnecessary to replenish it with fresh acid.

If the drop in the acid content is signalled in good time, a prolongation of the pickling time can be avoided by increasing the delivery of fresh acid. Conversely, the acid consumption can be reduced by avoiding an overly high acid content in the pickling solution. By monitoring the acid and iron content and accurately adjusting them, the outcome of pickling can be made more uniform for the same material to be pickled, and the capacity of the regeneration system can thus be more uniformly exploited.

The monitoring of industrial pickling baths is done predominantly by manual titration, for example by the titration of the free acid with caustic soda (NaOH) and the titration of the ferrous content with potassium permanganate ($KMnO_4$) or potassium dichromate ($K_2Cr_2O_7$). Here, $Fe^{2+}$ is oxidized into $Fe^{3+}$; this means that existing $Fe^{3+}$ in industrial pickling acid is not detected, in this method.

The prevailing loyalty to this simple manual method in the industry is explained by the fact that in pickling lines having a fixed, monitorable pickling program, periodic monitoring at intervals of 2 or 4 hours is normally sufficient, so that the use of automatic measuring methods is not yet considered to be absolutely necessary.

The situation is different in pickling lines in which the programs change, at short time intervals, betweeen material that is easy to pickle to material that is difficult to pickle. The pickling temperature, acid concentration and duration of pickling must be adapted continuously to the variable capacity for pickling of the material to be pickled, and the iron contents vary accordingly. The continuous changes necessitate monitoring of the pickling process at very much shorter time intervals; although certain relationships can be demonstrated retroactively by analysis, as a rule this is too late for intervention in the pickling process if an adaptation to the pickling program is to be made.

Various attempts have been made to replace manual titration with modern process titration and thus to drastically shorten the rate of monitoring. However, it has been found that the equipment used for this purpose, although it is successfully used for monitoring water or in the foodstuffs industry for instance, does not function reliably enough under the heavy-duty conditions of industrial metallurgy. The burettes very quickly become contaminated, so that the required measurement accuracy becomes questionable. Hence, frequent cleaning, which is time-consuming, is required.

Process titrators are also being used in combination with photometric measuring methods, the latter used for determining the iron content. In photometric measurement, the ferric component can be ascertained indirectly, as a difference between the total iron (in solution), determined with thioglycol acid, and the ferrous component, for instance determined with orthophenanthroline.

Because of their sensitivity to contaminants in the pickling solution, photometric measuring methods are usable only under limited conditions. Industrial pickling acid having a fluctuating content of hydrated salts, colloidally precipitated silicates ($SiO_2$ . aq), etc., contaminate the measurement cells. The gases and impurities forming during scale dissolution also have a perturbing effect. In this state, the pickling acid is not a pure solution but rather a suspension. To retain the suspended particles, filters disposed in the inlet side are used. These filters must be changed frequently. Testing, cleaning and recalibration must be performed repeatedly, making for a kind of operation which is very expensive for management and does not meet the required level of safety in industrial pickling baths.

The density and proportions of substances in acidic, aqueous ferrous salt solutions can be brought into a mathematical relationship sufficiently accurate for practical purposes; see J. Pearson and W. Bullough, J. Iron Steel Inst. 167 (1951), pp. 439–445; W. Fackert, Z. Stahl & Eisen [Iron and Steel Journal] 72 (1952), pp. 1196–1207; and G. Dunk and B. Meuthen, Z. Stahl & Eisen 82 (1962), pp. 1790–1796. The density of the solution is calculated from the concentrations of acid and iron. For one variable to be calculated, the other two must be known. The relationships are valid only for a particular temperature; the effect of temperature on the density is not taken into account.

The following efforts have been made to determine the acid and iron content by taking density measurements into account:

U.S. Pat. No. 2,927,871 discloses how such a mathematical relationship between the density, the specific conductivity and the contents of acid and iron in sulfuric acid pickling baths can be used for designing a continuous-function monitoring apparatus. This apparatus comprises a density measurement probe (operating according to the air bubble method) that is immersed in the pickling solution, and a conductivity measuring cell that is immersed in the pickling solution. Problems arise due to the short service life of the measuring probe and the falsification of the conductivity measurement values resulting from the deposition of oil onto the glass electrodes (when oiled bands are subsequently pickled, lubricating oil gets into the pickling acid). It has also been found that this measuring method cannot be used when pickling with hydrochloric acid.

Recent efforts toward further development of this type of measuring method and its widespread introduction into industrial practice have failed because the measurement of conductivity has proven to be too difficult. Essentially, there are three reasons for this:

Firstly, the conductivity is usable as a measurement variable only for dilute solutions. With an increasing content of ion-forming constituents, the forces of interaction increasingly inhibit the mobility of the ions, so that the conductivity does not increase further even though pickling acids must be classified as powerful electrolytes.

Secondly, the conductivity responds to all ionized charge carriers, which can increase in quantity in the pickling baths, depending on the pickling program. This includes the cations $Fe^{2+}$, $Fe^{3+}$, $Mn^{2+}$, $Al^{3+}$, $Cr^{3+}$ and the hydronium ion $H_3O^+$, as well as the anions $Cl^-$, $SO_4^{2-}$, $PO_4^{H3-}$. The conductivity is the product of elementary charge, the valence of the particular charge carrier, and the mobility and the number of the particles of the particular charge carrier. The more diverse the types of charge carriers, and the greater their number, the more complex are the electrochemical processes. No reliable information is available as to the mobility of the particles in concentrated solutions.

Finally, the production of hydrogen associated with the dissolution of scale is also a problem. This depends not only on the composition, thickness and properties of the scale film, but also on the inhibitor content; a measurement variable such as conductivity, which is greatly affected by the kinetics of this process, is understandably unsuitable for monitoring of the acid and iron contents in industrial pickling acids.

Japanese Patent 56 136 982 discloses a method for regulating constant concentrations of the acid content in pickling containers by metered replenishment of fresh acid or regenerate. The acid that is added is bound at a stoichiometric ratio by the iron present in the pickling bath. There is a linear relationship between the content of iron ions and the excess acid. If the acid content of the fresh acid supplied is known, then this relationship can easily be ascertained by a series of tests with graduated iron contents. The function thus obtained can now be used in one of the relationships, known from the professional literature, between density and acid and iron content, so that a mathematical relationship between density and acid content is obtained. This is supplemented with a temperature correction of the density.

With the aid of the relationship discovered in this way, the content of free acid in the pickling bath can be calculated from the density and temperature measured there, if the acid content of the incoming fresh acid is known. The calculation method is designed such that the determination of the iron content can be omitted. The result is used to regulate the supply of acid, the goal being to keep the content of free acid in the pickling container as uniform as possible.

The method has the disadvantage, however, that only the last pickling container supplied directly with fresh acid or regenerate can be monitored directly. As is well known, the content of acid and iron varies from container to container in the direction of band travel in a clearly graduated manner: While in sulfuric acid pickling, for example, acid contents of between 200 and 280 g/l and iron contents of between 60 and 100 g/l are found in the first container, the acid content in the final container ranges between 250 and 350 g/l, with iron contents between 20 and 60 g/l. The contents already fluctuate considerably in the first containers, as a function of the pickling program and the throughput; it is also difficult to check the change in the ratios in the first container resulting from a change in the supply of fresh acid in the final container. The temperature drop from the last monitored container to the first container into which the band runs also makes the control of the pickling process difficult.

In sulfuric acid pickling solutions, for example, which in addition to regenerate also require fresh acid for replenishment of used acid, or which in other words must be supplied from two sources at the same time, it is difficult to calculate beforehand how much acid must be replenished; among other factors, the influence of the heat of reaction must be taken into account. The ratios become even harder to check, if water is replenished as well.

It has been found that a measuring method that omits the checking of the iron content and furthermore monitors only the container coupled with the supply of fresh acid is inadequate to control the pickling process, in pickling lines in which the program changes frequently.

This substantial disadvantage of the previously known measuring method can be avoided only if it is possible to find a method that makes it possible to ascertain not only the acid contents but also the iron contents, and as much as possible in all containers regardless of the replenishment of acid. In that case, the precondition that the acid content of the fresh acid supplied must be constant and known is eliminated.

Japanese Patent 56 136 982 provides no information as to the type of density measurement, so that it does not teach whether the aforementioned disadvantages of density measurement found in U.S. Pat. No. 2,927,871 can be overcome.

SUMMARY OF THE INVENTION

With this prior art as the point of departure, it is an object of the present invention to provide a meauring method with which acid and iron contents in a plurality of containers of one pickling line can be determined regardless of the flow of substance, or in other words regardless of the throughput and properties of the material to be pickled.

According to the invention, the above and other objects are attained in that the pickling liquid of the pickling bath is irradiated by two gamma radiations having respectively different energy levels, and the partial densities are obtained from the measured counting rates and known substance-specific and/or system-specific parameters and calibration values in a control and evaluation unit. It has been found that the composition of the pickling liquid, substantially comprising the three components of water, acid and iron salt, can be determined with an accuracy sufficient for industrial purposes, by using a combination of only two radiometric measurement sensors.

DESCRIPTION OF THE PREFERRED EMBODIMENTS

Figure 1:
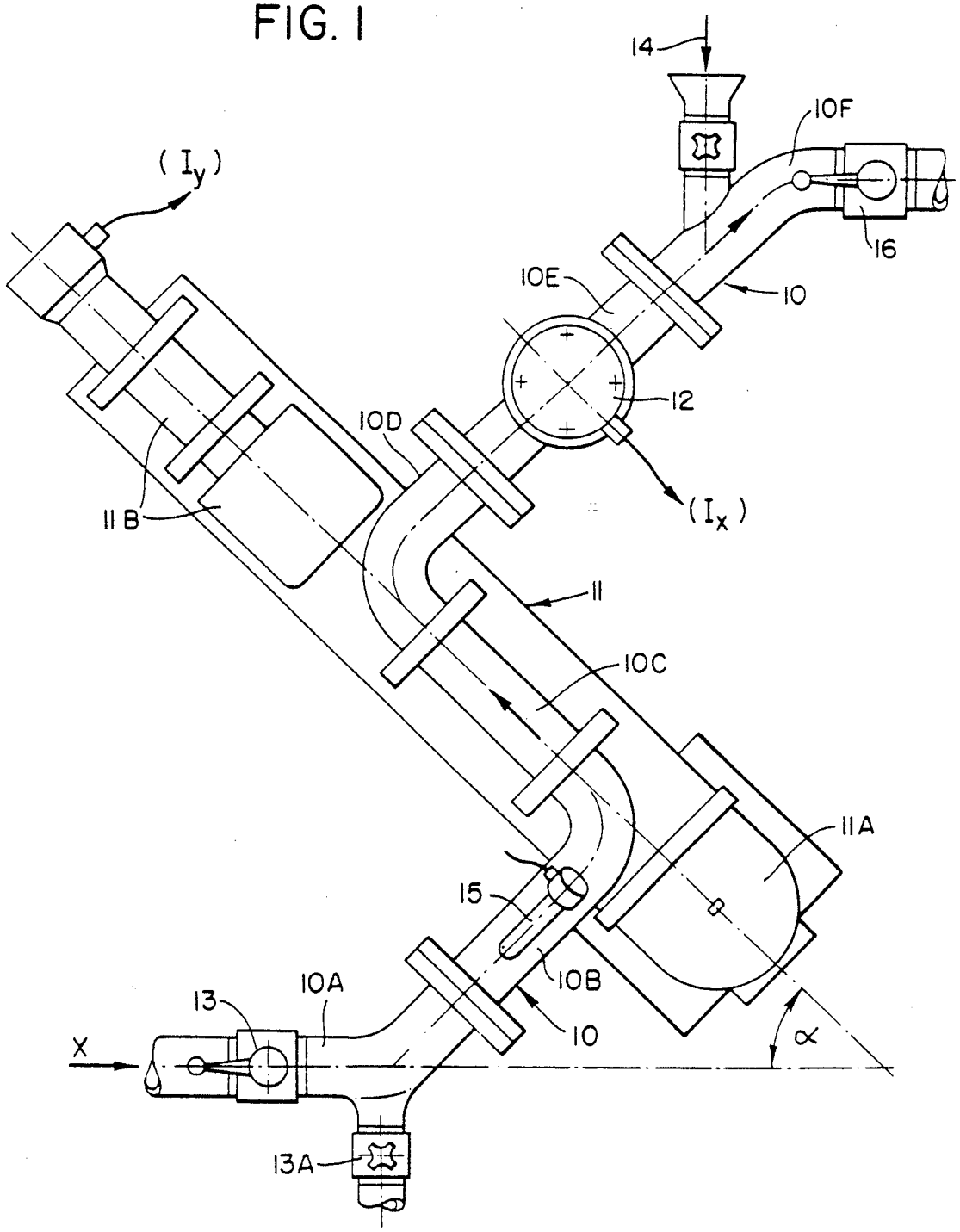
FIG. 1 is a pictorial view showing the radioactive measurement routes in a conduit carrying pickling liquid.

When a liquid is irradiated in a segment of tubing of defined measurement length, the absorption of the gamma radiation is a function of density. However, the three substantial substance components—that is, the water as the solvent, the free acid and the fully dissociated iron salt—contribute to the density of the pickling solution depending on their proportion in the pickling solution. Each substance ingredient absorbs the gamma radiation in a substance-specific manner, characterized by the mass extinction coefficients. The resultant attenuation of intensity is thus distributed among three proportions, which are determined by the product of mass extinction coefficient times density (content per unit of volume of pickling solution):

$$I = I_o \cdot \exp(-L \cdot \eta \cdot r) = I_o \cdot \exp\left[-L \sum_{i=1}^{3} (\eta_i \cdot r_i)\right] \quad (1)$$

where:

I: radiation striking the detector $I_o$: unattenuated radiation eta ($\eta$): mass extinction coefficient of the pickling solution $eta_i$: mass extinction coefficient of the substance i r: density of the pickling solution L: irradiated measuring length $r_i$: partial density in the pickling solution The subscripts i = 1, 2, 3 have the following meanings:

1: water

2: acid

3: iron salt

If the two radiation sources are used in combination, then from (1), the following equation system is attained:

$$\left.\begin{aligned} L_x^{-1} \cdot \ln (I_o I^{-1})_x &= \eta_{x1} \cdot r_1 + \eta_{x2} \cdot r_2 + \eta_{x3} \cdot r_3 \\ L_y^{-1} \cdot \ln (I_o I^{-1})_y &= \eta_{y1} \cdot r_1 + \eta_{y2} \cdot r_2 + \eta_{y3} \cdot r_3 \end{aligned}\right\} \quad (2)$$

Subscripts:

x: low-energy radiation, e.g. $^{241}$Am, 60 keV y: higher-energy radiation, e.g. $^{137}$Cs, 660 keV The left-hand side of each of equations (2) contains the outcome of measurement of the particular radiation measuring sensor, multiplied by the inverse value of the measurement length L, while the right-hand side having the partial densities $r_1$, $r_2$, and $r_3$, contains three unknowns.

Thus two equations (2) having three unknowns are available, from which the partial density $r_2$ of the acid (the content of free acid) and the partial density $g_3$ of the iron salt are to be determined. To be able to solve the equation system, a further determination equation must be discovered.

There is a linear relationship between the density of the solution r and the partial density $r_2$ of the acid in the two-substance system of water and acid, at typical pickling concentrations:

$$r(r_2) = r_o + m \cdot r_2. \quad (3)$$

The magnitude $r_o$ corresponds to the density of the solution when $r_2 = 0$, that is, the density of the solvent, water. The increase m in the density with the acid content $r_2$, however, is a function of the iron salt content $r_3$: the more iron salt in the pickling solution, the less the increase in density as the acid content increases.

This relationship is analogously applicable for the density of an iron salt solution that is mixed incrementally with acid. The linearity of the relationship is maintained, as long as only the content of one of the two dissolved substances in the three-substance water, acid and iron salt system varies.

The above relationships lead to the following general relationship between the density of the pickling solution and the contents of the two substances in solution:

$$r(r_2, r_3) = k_o + k_1 r_2 + k_2 r_3 + k_3 \cdot r_2 \cdot r_3 \quad (4)$$

in which $k_o$, $k_1$, $k_2$, and $k_3$ are constants, which must be ascertained empirically. They can be determined from a sufficiently wide range of density measurements and associated analysis values for acid and iron salt.

Equation (4), via the identity $$r = r_1 + r_2 + r_3 \quad (5)$$

furnishes the desired third determination equation for the partial density of the water in the pickling solution:

$$r_1 = k_o + (k_1 - 1) r_2 + (k_2 - 1) r_3 + k_3 r_2 \cdot r_3 \quad (6)$$

Substituted into the equation system (2), this leads to a quadratic equation, from which the acid content, or alternatively the iron salt content, can be explicitly calculated:

$$r_2 = -\frac{1}{2}\frac{P_2}{P_1} + \sqrt{\frac{1}{4}\left(\frac{P_2}{P_1}\right)^2 - \frac{P_3}{P_1}}$$

$$r_3 = \frac{A - a_1 r_2}{a_2 + a_3 r_2} \quad (7)$$

in which:

$$a_1 = [\eta_{x2} + \eta_{x1}(k_1 - 1)]; \quad b_1 = [\eta_{y2} + \eta_{y1}(k_1 - 1)]$$
$$a_2 = [\eta_{x3} + \eta_{x1}(k_2 - 1)]; \quad b_2 = [\eta_{y3} + \eta_{y1}(k_2 - 1)]$$
$$a_3 = \eta_{x1} \cdot k_3/k_T^\circ; \quad b_3 = \eta_{y1} \cdot k_3/k_T^\circ$$
$$k_T^\circ = 1 - (T_{ist} - T_M) \cdot \gamma$$
$$P_1 = b_1 a_3 - a_1 b_3$$
$$P_2 = b_1 a_2 - a_1 b_2 + A b_3 - B a_3$$
$$P_3 = A b_2 - B a_2$$
$$A = \frac{1}{L_x} \ln\left(\frac{I_{ox}}{I_x}\right) - \eta_{x1} k_o \cdot k_T^\circ$$
$$B = \frac{1}{L_y} \ln\left(\frac{I_{oy}}{I_y}\right) - \eta_{y1} k_o \cdot k_T^\circ \quad (8)$$

$\gamma$ = coefficient of expansion

Since the mass extinction coefficients eta are independent of the temperature, only the influence of temperature on the density needs to be taken into account, which is done via the term $k_T^\circ$ in (8), on the condition that the actual operating temperature $T_{ist}$ of the pickling solutions fluctuates about a mean temperature $T_M$.

A measurement of the actual temperature $T_{ist}$ is a precondition for the temperature correction of the density; this measurement of actual temperature is indispensable in any case in controlling the pickling process, if the precipitation of monohydrate $FeSo_4 \cdot H_2O$ is to be avoided, for instance in sulfuric acid pickling. Accurate information on which lines of concentration must not be exceeded, as a function of the pickling temperature, is currently available. The possibilities which the measuring method according to the invention offer for precisely determining the instantaneous acid and iron contents makes it possible to control the pickling process just below the limits of saturation, without the fear that iron salts will crystallize out.

The product term having the coefficient $k_3$ in equation (6) is a correction factor; it is finally responsible for the quadratic character of equations (2) and their solutions (7).

In measurements of hydrochloic acid pickling solutions, it was found that sufficiently accurate measurements of density could be performed if a linear function, instead of equation (4), is selected:

$$r(r_2, r_3) = l_o + l_1 r_2 + l_2 r_3 \quad (9)$$

With this linear statement (9). equations (2) have the following solutions for the acid and iron salt concentration:

$$r_2 = \frac{a_2 B - b_2 A}{a_2 b_1 - a_1 b_2}; \quad r_3 = \frac{B - b_1 r_2}{b_2} \quad (10)$$

-continued $$A = \frac{1}{L_x} \ln\left(\frac{I_{ox}}{I_x}\right) - \eta_{x1} \cdot l_o \cdot k_T^\circ$$
$$B = \frac{1}{L_y} \ln\left(\frac{I_{oy}}{I_y}\right) - \eta_{y1} \cdot l_o \cdot k_T^\circ$$
$$a_1 = [\eta_{x2} + \eta_{x1}(l_1 - 1)]; \quad b_1 = [\eta_{y2} + \eta_{y1}(l_1 - 1)]$$
$$a_2 = [\eta_{x3} + \eta_{x1}(l_2 - 1)]; \quad b_2 = [\eta_{y3} + \eta_{y1}(l_2 - 1)] \quad (11)$$

The parameters $L_x$, $L_y$, $I_{ox}$ and $I_{oy}$ contained in equations (8) and (11) can be obtained by calibration, as described hereinafter.

The mass extinction coefficients $eta_{xi}$ and $eta_{yi}$ for the components of the pickling liquid are in principle material variables, but under some circumstances they also depend substantially on the kind of measuring technology used.

For sufficiently accurate measurement, it is therefore suitable to determine these coefficients, prior to performing the measurements of the pickling liquid. To this end, calibrating measurements that are substantially based on the successive measurement of individual substance components and the selected combinations of such substances can be used.

Similarly to the calibration method described in detail below for obtaining the parameters $L_x$, $L_y$, $I_{ox}$ and $I_{oy}$, the mass extinction coefficients from (2) can also be determined successively, so that the latter need not be described in further detail.

An exemplary embodiment of the apparatus according to the invention for performing the above-described method will now be described in connection with the drawings.

In the device shown in FIG. 1, pickling liquid, that is, liquid containing the substance components of water, acid and iron salt, is pumped from bottom to top through a conduit 10 in the direction of the arrow X. Conduit 10 is oriented and configured such that in particular hydrogen gas that may possibly be produced during dissolution of scale cannot back up and falsify the measurements; structurally, this means tha the longitudinal axis of each of at least the sections 10B . . . 10E of conduit 10 has a vertical component along which fluid flows upwardly so that gas cushions cannot become trapped inside the radiometric measurement paths.

The initial section 10A of conduit 10 has a cutoff valve 13 and an outlet valve 13A, and the ensuing conduit section 10B contains a resistance thermometer 15 for temperature measurement. Section 10C follows, and is bent upwardly at a right angle to section 10B, and extends along the first radiometric measurement path 11. Path 11 extends between a gamma radiation source 11A and a scintillation counter 11B. Gamma radiation emitted by radiation source 11A, which is a $^{137}Cs$ emitter, extends coaxially to the longitudinal axis of conduit section 10C, which is inclined at an angle $\alpha$ of approximately 45° with respect to the horizontal.

Via a further elbow section 10D, conduit 10 leaves this first radiometric measurement path. A further straight conduit section 10E, which is likewise inclined upwardly, follows section 10D. A second radiometric measurement device 12 having a $^{241}Am$ emitter is associated with section 10E. Device 12 provides a measuring path perpendicular to the plane of FIG. 1.

Following these two measurement paths, conduit 10 is finally extended with an end section 10F, with which a cutoff valve 16 and a fill spout 14 are associated.

The radioactive sensors used are measuring instruments known per se, which need not be described in detail. For the radiometric measurement device 12, an instrument commercially available under the name "LB 379" from Laboratorium Prof. Dr. Berthold, Wildbad, Federal Republic of Germany, can be used; for the radiometric measuring apparatus 11A/11B, an "LB 386-1C" system from the same company can be used.

The two radiometric sensors thus furnish the counting rates Ihd x and $I_y$, respectively, at their outputs, from which the partial densities of the pickling liquid flowing through the associated measuring paths can be obtained, as extensively described above.

From the above-given equation systems 7 and 8 or 10 and 11, it can be found that to calculate the partial densities $r_2$ and $r_3$, the parameters $L_x$, Lhd y and $I_{ox}$, $I_{oy}$ must be determined—that is, parameters that are specific for the particular intensity of the radioactive sources used, on the one hand, and for the geometry of the measurement paths, on the other.

Here a further advantage of the concept according to the invention comes into play, namely the possibility of an extremely simple calibration of the apparatus of FIG. 1, in that only two measurements of the counting rates $I_x$ and $I_y$, for two different substances in conduit 10, need to be performed.

As "substances", air and water can suitably be selected as "calibration substances". In practice, this is done in that a first measurement is performed with conduit 10 empty (that is, air-filled) , which yields the counting rates $I_x$(air) and $I_y$(air). In a second calibration measurement, conduit 10 is then filled with water through the fill spout 14 (with the valve 13 and 13A closed), and another measurement is performed, producing the two counting rates $I_x$(water) and $I_y$(water).

Thus, on the basis of these two calibration measurements, four calibration rate measurement values are available, from which, in accordance with equation (2), the desired constants $I_{ox}$, $I_{oy}$, $L_x$ and $L_y$ can be determined in a simple manner as follows:

$$I_{ox} = I_x\,(\text{air}) \tag{12}$$

$$I_{oy} = I_y\,(\text{air})$$

$$L_x = -\frac{1}{\eta_{x1} r_1} \ln[I_x\,(\text{water})/I_{ox}]$$

$$L_y = -\frac{1}{\eta_{y1} r_1} \ln[I_y\,(\text{water})/I_{oy}]$$

The mass extinction coefficients $eta_{xi}$ and $eta_{yi}$ can also be ascertained in a comparable manner, as already described above.

With the values thus ascertained, all the constants from equations 8 and 11 can be calculated, and thus the partial densities $r_2$ and $g_3$ can also be calculated from the associated equations 7 and 10.

With this calibration, made possible by the concept according to the invention, simple and reliable operation of the apparatus according to the invention is assured.

Figure 2:
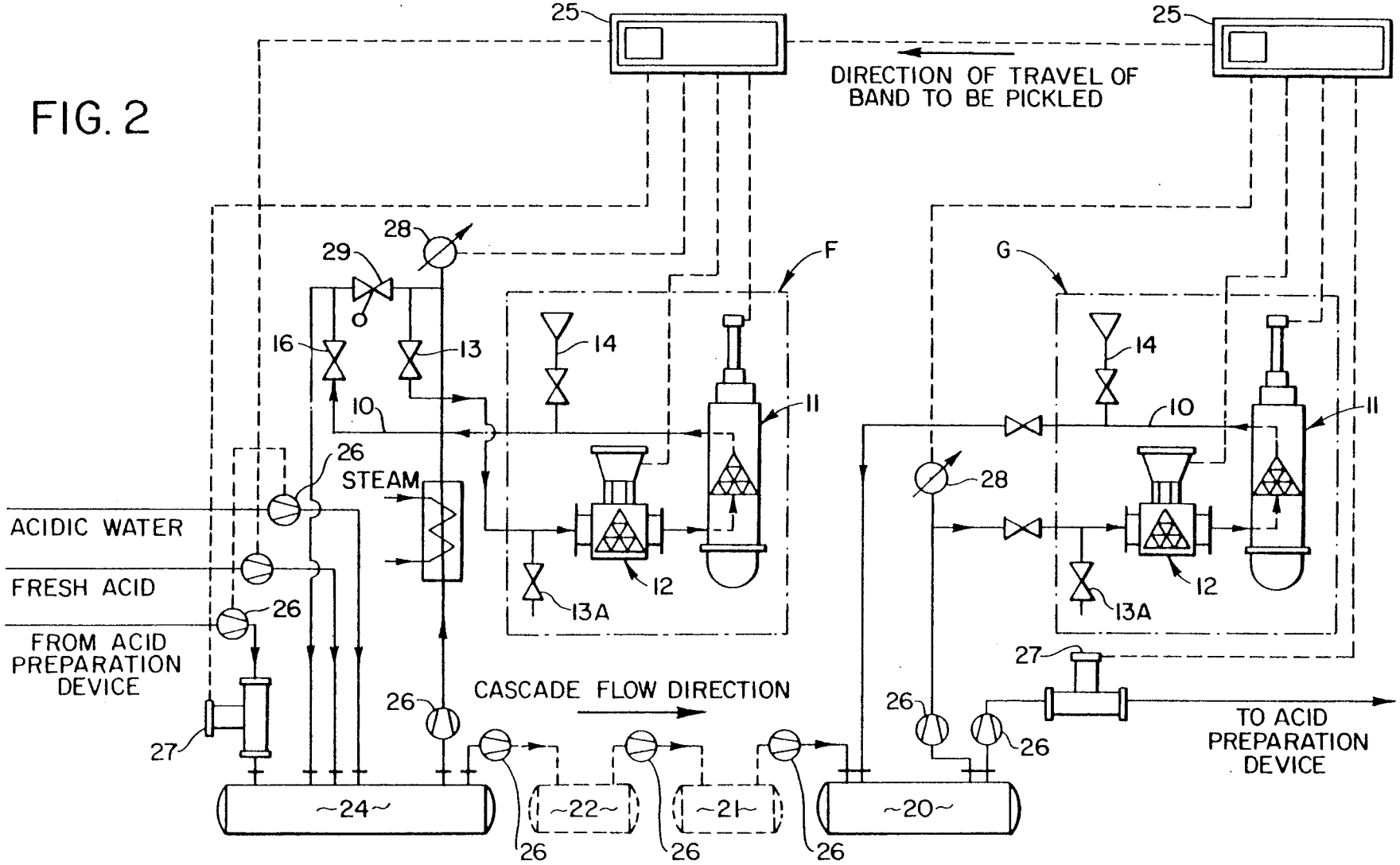
FIG. 2 is a pictorial view of a pickling system containig two of the devices of FIG. 1.

FIG. 2 shows how radiometric measuring devices according to the invention are integrated into a pickling system, for determining the partial densities. The radiometric measuring paths 11 and 12 and the associated valves 13A and 14 are schematically shown inside the areas F and G, delimited by dot-dash lines.

Along the bottom of FIG. 2, supply containers 20, 21 and 22 of the various pickling baths, which are connected to one another via pumps 26, are shown; they are supplied from a preparation container 4 which receives acidic water, fresh acid and prepared acid (likewise via pumps 26 and via a flow meter 27), so that a first mixture of the substances whose partial densities are to be determined forms in preparation container 24. This mixture is heated via a steam heat exchanger in a heating loop.

The first radiometric density measuring device F is located between the two cutoff valves 13, 16 in a bypass of this heating loop, and the flow ratio can be adjusted via a throttle valve 29.

A second density measuring device G is located in a separate loop (conduit 10) leading to the working container 20.

Dashed lines in FIG. 2 represent signal lines, which report the measured counting rates $I_x$ and $I_y$, the temperature of the pickling liquid, ascertained by temperature sensors 28, and the flow rate reported by flow meters 27, to a respective control and evaluation unit 25 for each measuring device, in which the above-described calculation of the partial densities $r_2$ and $r_3$ is then performed.

Suitably, a plurality of these control and evaluation units 25 can be combined; in that case, they for instance control the pump 26 intended for the supply of fresh acid, in order to adapt the current, or in other words continuously measured, composition of the pickling liquid to current requirements of the particular product being processed.

EXAMPLES

The obtaining of practical values for the constants in equations 4–8 and 9–11 will now be described for one example of sulfuric acid pickling and one example of hydrochloric acid pickling:

1. Sulfuric Acid Pickling

From an operating sulfuric acid pickling line, a number of acid samples of different compositions were drawn from the first and last pickling baths, over a period of several days The density, the content of free acid and the iron salt content were determined for these samples. Additionally, the content of impurities was tested; these substances, primarily metal ions and metal oxides but also hydrated silicates, carbon and organic substances, total no more than from 2 to 5 g/l.

The density of the pickling solutions was determined at a temperature of 80° C.

With the constant calculated from this range of values by means of multiple linear regression, the partial density of the solution in grams per liter at 80° C. is obtained in accordance with equation 4 as:

$$r(r_2, r_3) = 972 + 0.60\, r_2 + 0.94\, r_3 - 0.00057\, r_2 \cdot r_3 \tag{4A}$$

With known mass extinction coefficients of the X and Y radiations for water, sulfuric acid and iron salt, the parameters of equations 8 are calculated as follows:

| | |
|---|---|
| $a_1 = 14.49\ dm^2/g$ | $b_1 = 4.37\ dm^2/g$ |
| $a_2 = 56.2\ dm^2/g$ | $b_2 = 6.77\ dm^2/g$ |

-continued

| | |
|---|---|
| $a_3 = -0.0102\ dm^2/g$ | $b_3 = -4.06 \cdot 10^{-3}\ dm^2/g$ |

2. Hydrochloric Acid Pickling

A comparable range of values from analogously tested and analyzed acid samples from a hydrochloric acid pickling line, after multiple linear regression, yielded the constants of equation 9, so that the density of the solution in grams per liter at 80° C. becomes:

$$r(r_2, r_3) = 972 + 0.44\ r_2 + 0.88\ r_3 \quad (9A)$$

With known mass extinction coefficients, the parameters a and b of equations 11 become:

| | |
|---|---|
| $a_1 = 24.4\ dm^2/g$ | $b_1 = 2.49\ dm^2/g$ |
| $a_2 = 70.0\ dm^2/g$ | $b_2 = 5.78\ dm^2/g$ |

The contaminants analyzed in these acid samples range, in total, on the order of magnitude between 1 and 3 g/l.

What is claimed is:

1. A method for measuring and monitoring the partial densities of metal and acid in a bath of pickling liquid, comprising: irradiating the pickling liquid by gamma radiations (x,y) having two different energy levels to obtain two gamma radiation counting rates ($I_x$, $I_y$); and deriving representations of the partial densities ($r_2$, $r_3$) of two components of the liquid from the measured counting rates and known substance-specific and/or system-specific parameters and calibration values in a control and evaluation unit, wherein said step of deriving is performed in accordance with the following equations:

$$r_1 = k_0 + (k_1 - 1)r_2 + (k_2 - 1)r_3 + k_3 r_2 r_3$$

$$r_2 = -\frac{P_2}{2P_1} + \sqrt{\frac{1}{4}\left(\frac{P_2}{P_1}\right)^2 - \frac{P_3}{P_1}}$$

$$r_3 = \frac{A - a_1 r_2}{a_2 + a_3 r_2}$$

in which:

$$a_1 = [\eta_{x2} + \eta_{x1}(k_1 - 1)];\ b_1 = [\eta_{y2} + \eta_{y1}(k_1 - 1]$$

$$a_2 = [\eta_{x3} + (k_2 - 1)\eta_{x1}];\ b_2 = [\eta_{y3} + (k_2 - 1)\eta_{y1}]$$

$$a_3 = \eta_{x1} \cdot \frac{k_3}{k_T^0}\ b_3 = \eta_{y1} \cdot \frac{k_3}{k_T^0}$$

$$k_T^0 = 1 - (T_{ist} - T_m) \cdot \gamma$$

$$P_1 = b_1 a_3 - a_1 b_3$$

$$P_2 = b_1 a_2 - a_1 b_2 + A b_3 - B a_3$$

$$P_3 = A b_2 - B a_2$$

$$A = \frac{1}{L_x} \ln\left(\frac{I_{ox}}{I_x}\right) - \eta_{x1} k_0 \cdot k_T^0$$

$$B = \frac{1}{L_y} \ln\left(\frac{I_{oy}}{I_y}\right) - \eta_{y1} k_0 \cdot k_T^0$$

$\eta_{x2}$ and $\eta_{x3}$ are the mass extinction coefficients of respective components with respect to radiation x;

$\eta_{y2}$ and $\eta_{y3}$ are the mass extinction coefficients of respective components with respect to radiation y;

$\eta_{x1}$ and $\eta_{y1}$ are the mass extinction coefficients of a reference liquid with respect to radiations x and y, respectively;

$k_o$, $k_1$, $k_2$ and $k_3$ are empirically determined constants;

$T_{ist}$ is the actual operating temperature of the pickling liquid bath;

$T_m$ is the mean temperature of the bath;

$\gamma$ is the coefficient of expansion of the bath;

$L_x$ and $L_y$ are the measurement length for radiations x and y, respectively;

$I_{ox}$ and $I_{oy}$ are the unattenuated intensities of radiations x and y, respectively.

2. A method as defined in claim 1 wherein the two components are an acid and an iron salt.

3. A method as defined by claim 1 wherein said step of deriving is performed in accordance with the following equations:

$$r_2 = \frac{a_2 B - b_2 A}{a_2 b_1 - a_1 b_2}$$

$$r_3 = \frac{B - b_1 r_2}{b_2}$$

in which:

$$A = \frac{1}{L_x} \ln\left(\frac{I_{ox}}{I_x}\right) - \eta_{x1} \cdot l_o \cdot k_T^*$$

$$B = \frac{1}{L_y} \ln\left(\frac{I_{oy}}{I_y}\right) - \eta_{y1} \cdot l_o \cdot k_T^*$$

$$a_1 = [\eta_{x2} + \eta_{x1}(l_1 - 1)];\quad b_1 = [\eta_{y2} + \eta_{y1}(l_1 - 1)]$$

$$a_2 = [\eta_{x3} + \eta_{x1}(l_2 - 1)];\quad b_2 = [\eta_{y3} + \eta_{y1}(l_2 - 1)]$$

$\eta_{x2}$ and $\eta_{x3}$ are the mass extinction coefficients of respective components with respect to radiation x;

$\eta_{y2}$ and $\eta_{y3}$ are the mass extinction coefficients of respective components with respect to radiation y;

$\eta_{x1}$ and $\eta_{y1}$ are the mass extinction coefficients of a reference liquid with respect to radiations x and y, respectively;

$l_o$, $l_1$ and $l_2$ are empirically determined constants;

$k_T^* = 1 - (T_{ist} - T_m)$ $T_{ist}$ is the actual operating temperature of the pickling liquid bath;

$T_m$ is the mean temperature of the bath;

$\gamma$ is the coefficient of expansion of the bath;

$L_x$ and $L_y$ are the measurement length for radiations x and y, respectively;

$I_{ox}$ and $I_{oy}$ are the unattenuated intensities of radiations x and y, respectively.

4. A method as defined by claim 1 wherein said step of deriving further comprises preliminarily performing two calibrations, measurements by irradiating substances other than the pickling liquid to be monitored, and determining, from the calibration measurement results, said system-specific parameters constituted by the counting rates II$_{ox}$, $I_{oy}$) of the unattenuated gamma radiations (x, y) and the associated irradiated measurement lengths ($L_x$, $L_y$).

5. A method as defined by claim 4 wherein one of the substances other than the pickling liquid to be monitored is air.

6. A method as defined by claim 4 wherein one of the substances other than the pickling liquid to be monitored is water.

7. An apparatus for measuring and monitoring partial densities of metal and acid in a bath of pickling liquid by irradiating the pickling liquid by gamma radiations (x, y) having two different energy levels to obtain two gamma radiation counting rates ($I_x$, $I_y$) an deriving representations of the partial densities ($r_2$, $r_3$) of two components of the liquid from the measured counting rates and known substance-specific and/or system-specific parameters and calibration values, said calibration values being obtained by irradiating with gamma radiation substances other than said pickling liquid to be monitored, said system-specific parameters being determined by counting rates ($I_{ox}$, $I_{py}$) of unattenuated gamma radiations (x, y) and associated irradiated measurement lengths ($L_x$, $L_y$), said apparatus comprising:

a conduit connected to define a flow path for one of the pickling liquid and each of the subtances other than the pickling liquid, said conduit having two measurement locations traversing said flow path and having a first section at which a first one of said measurement locations is located and which defines a portion of said flow path which is coaxial with the given radiation path;

two gamma emitters each disposed for directing gamma radiation through said flow path at a respective one of said measurement locations; and a control and evaluating unit for deriving said representations of said partial densities.

8. An apparatus as defined by claim 7 wherein one of said emitters is a $^{137}Cs$ emitter which emits gamma radiation along a first given radiation path.

9. An apparatus as defined by claim 8 wherein one of said emitters is a $^{241}Cs$ emitter which emits gamma radiation along a second given radiation path and said conduit has a second section at which a second one of said measurement locations is located and which defines a portion of said flow path which is perpendicular to the second given radiation path.

10. An apparatus as defined by claim 7 wherein one of said emitters is a $^{241}Cs$ emitter which emits gamma radiation along a given radiation path and said conduit has a section at which one of said measurement locations is located and which defines a portion of said flow path which is perpendicular to the given radiation path.

11. An apparatus as defined by claim 7 wherein: said conduit has a pickling liquid inlet and a pickling liquid outlet; said measurement locations are disposed between said inlet and said outlet; said conduit is oriented with said outlet at a higher elevation than said inlet so that the feeding in of pickling liquid takes place at the lowermost section of said conduit; and said conduit is formed so that the liquid flow where said measurement locations traverse said flow path has a vertically oriented component at each point.

12. An apparatus as defined by claim 11 wherein one of said emitters is a $^{137}Cs$ emitter which emits gamma radiation along a first given radiation path and said portion of said flow path is oriented to cause pickling liquid to flow upwardly through said first one of said measurement locations at an angle $\alpha$ of approximately 45° to the horizontal.

13. An apparatus as defined by claim 7 in a pickling installation comprising: a plurality of pickling liquid supply containers and a pickling liquid preparation container; and means for connecting said conduit to one of said supply containers and to said preparation container.

14. The combination defined by claim 13 further comprising: means defining a flow loop for carrying the pickling liquid; a plurality of cut-off valves connecting said conduit in parallel with said flow loop; and a throttle valve connected in said flow loop for controlling the flow of pickling liquid through said conduit.

15. The combination defined by claim 13 wherein the are a pluralty of said appara,tuses each connected to a repective one of said supply containers and said preparation container.

16. An apparatus as defined by claim 7 further comprising a temperature sensor disposed for sensing the temperature of fluid in said conduit, and wherein the two gamma radiation counting rates and the measurement values produced by said sensor are delivered to the control and evaluation unit.

* * * * *

UNITED STATES PATENT AND TRADEMARK OFFICE

CERTIFICATE OF CORRECTION

PATENT NO. : 5,065,417

DATED : November 12, 1991

INVENTOR(S) : Jurgen Behringer, et al.

It is certified that error appears in the above-identified patent and that said Letters Patent is hereby corrected as shown below:

In column 13, line 40, delete "$^{241}$Cs" and substitute therefor --$^{241}$Am--.

In column 14, line 2, delete "$^{241}$Cs", and substitute therefor --$^{241}$Am--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*